US005427271A

United States Patent [19]

Wang

[11] Patent Number: 5,427,271

[45] Date of Patent: Jun. 27, 1995

[54] CANTEEN WITH A SPRING BIASED VALVE ACTUATED BY A PUSH BUTTON

[76] Inventor: Paul S. Wang, 22428 Steeplechase La., Diamond Bar, Calif. 91765

[21] Appl. No.: 254,546

[22] Filed: Jun. 6, 1994

[51] Int. Cl.[6] ..... B65D 51/18

[52] U.S. Cl. ..... 220/715; 220/714; 220/502; 220/255; 220/719

[58] Field of Search ..... 220/715, 714, 501, 502, 220/255, 254, 703, 711, 713, 719, 505, 524; 222/509, 518, 559

[56] References Cited

U.S. PATENT DOCUMENTS

| | | | |
|---|---|---|---|
| 2,054,145 | 9/1936 | Tandy | 220/255 |
| 2,065,019 | 12/1936 | Pederson | 220/255 |
| 3,656,664 | 4/1972 | Kelly | 222/559 |
| 4,051,984 | 10/1977 | Ho | 222/518 |
| 4,099,642 | 7/1978 | Nergard | 220/715 |
| 4,165,013 | 8/1979 | Lutz | 220/714 |
| 4,190,173 | 2/1980 | Mason et al. | 220/715 |
| 5,169,016 | 12/1992 | Hinz, Jr. | 220/715 |
| 5,203,468 | 4/1993 | Hsu | 220/254 |
| 5,282,541 | 2/1994 | Chen | 220/254 |
| 5,310,081 | 5/1994 | McCabe | 220/715 |

FOREIGN PATENT DOCUMENTS

| | | | |
|---|---|---|---|
| 2729588 | 7/1978 | Germany | 220/715 |

*Primary Examiner*—Stephen J. Castellano

[57] ABSTRACT

A canteen including a cylindrical container and a head threaded to the open top of the container, and also having a flip-up cap pivotally mounted on the head. A push-button is provided at the side of the head which, when actuated, flips up the cap to an pen position, and also pushes a spring-biased plunger away from the drinking hole to open the drinking hole. When the push-button is released, the spring-biased plunger moves to close the drinking hole. Accordingly, by operating a single push-button, the user causes the cap to flip up to an open position, and also causes the drinking hole to open, the drinking hole remaining open so long as the push-button is held by the operator in its actuated position.

3 Claims, 2 Drawing Sheets

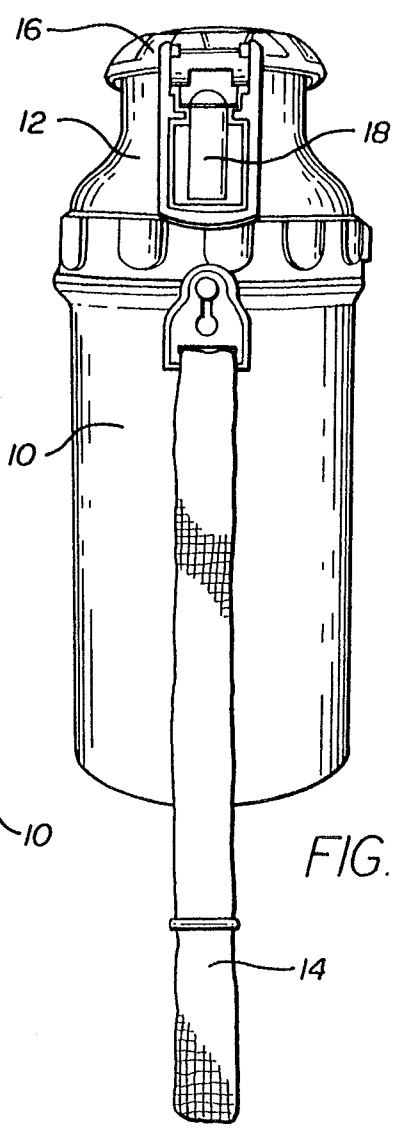
FIG. 2
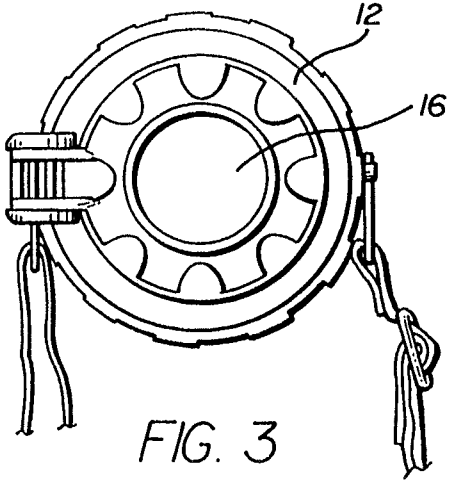
FIG. 3
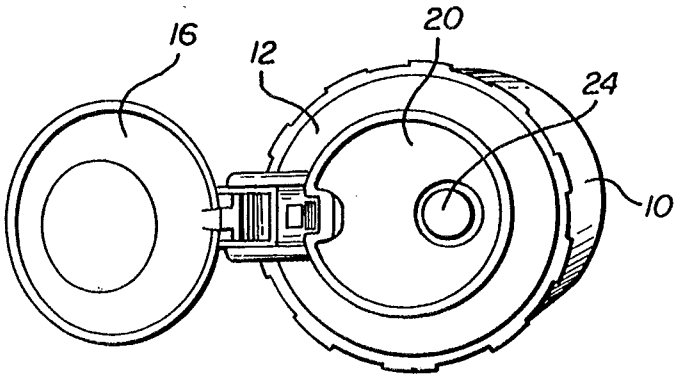
FIG. 4
FIG. 1
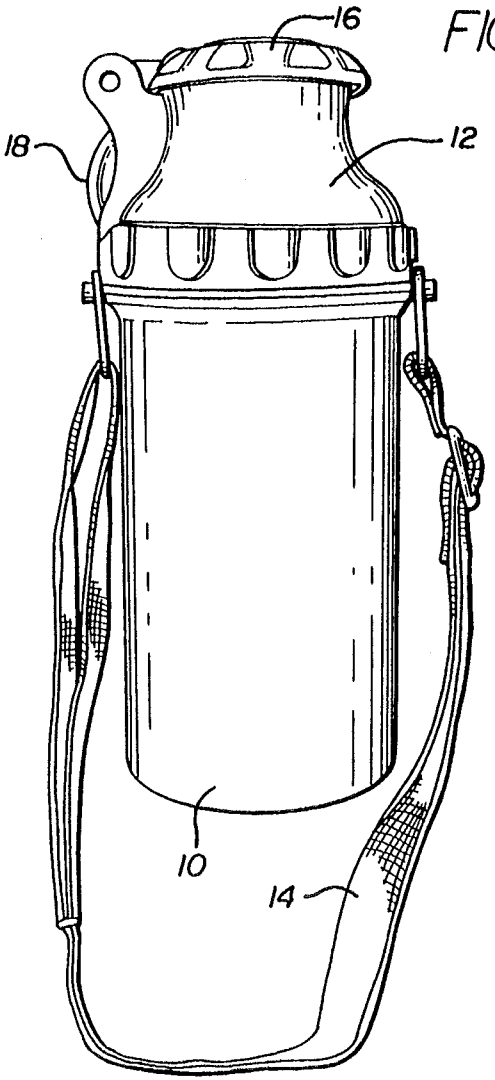

CANTEEN WITH A SPRING BIASED VALVE ACTUATED BY A PUSH BUTTON

BACKGROUND OF THE INVENTION

The invention is concerned with a canteen which may conveniently be carried on camping trips, picnics, games and the like; and which may be filled, for example, with water, lemonade, or other drinks or liquids.

SUMMARY OF THE INVENTION

The canteen of the invention comprises a flip-up cap pivotally mounted on the head of the canteen and which may be opened freely by pushing a button on the side of the head. The top of the head has a peripheral rim which defines a drinking area that is enclosed by the cap, the cap maintaining the drinking area clean and sanitary. A drinking hole is formed in the head at the bottom of the drinking area, and the drinking hole is normally held closed by a plunger. When the push-button is actuated to flip up the cap, it also causes the plunger to move away from the drinking hole. Accordingly, the simple operation of actuating the push-button first causes the cap to flip up to an open position and also causes the drinking hole to open so that the contents of the canteen may be drunk from the drinking area.

The plunger is part of a spring-loaded plunger subassembly which is removably mounted within the head, and is easily removed to facilitate easy and thorough cleaning of the subassembly and of the interior of the head.

BRIEF DESCRIPTION OF THE DRAWINGS

FIG. 1 is a side view of a canteen representing one embodiment of the invention with its cap in a closed position;

FIG. 2 is a view similar to FIG. 1 but with the canteen turned ninety degrees on its longitudinal axis;

FIG. 3 is a top view of the canteen, likewise with its cap closed;

FIG. 4 is a perspective view taken from the top of the canteen and showing the cap in an open position;

DETAILED DESCRIPTION OF THE ILLUSTRATED EMBODIMENT

The canteen shown in FIGS. 1–4 includes a cylindrical drink container having an open top and a closed bottom, and the canteen further including a head 12 which is threaded to the open top of container 10. The canteen may conveniently carried by a flexible shoulder strap 14 which is pivotally attached to the upper rim of container 10.

Figure 8:
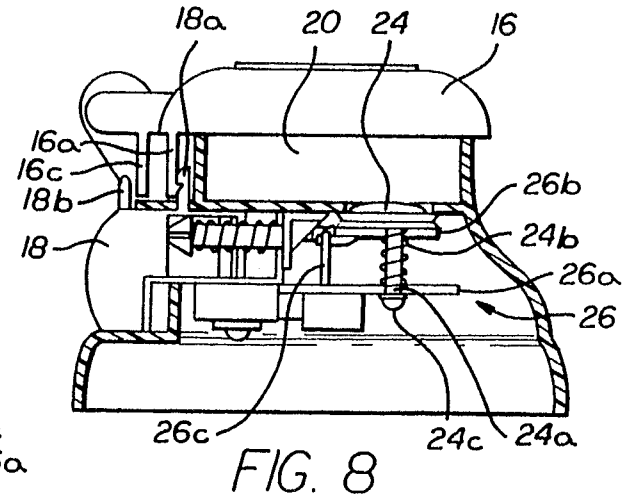
FIG. 8 is a side section of the head, when the cap is in its closed position, and illustrating various mechanisms for coupling the push-button to the plunger subassembly and to the head.
Figure 9:
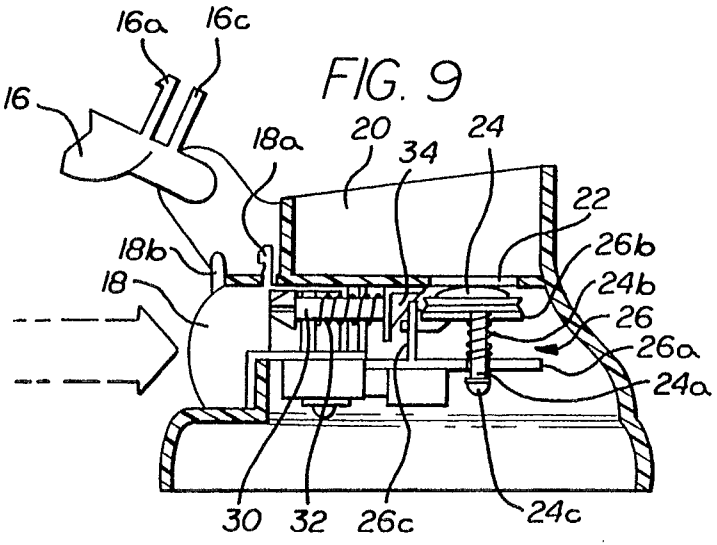
FIG. 9 is a section like FIG. 8, but with the cap flipped up to its open position, and with the plunger displaced from the drinking hole to open the drinking hole.

A flip-up cap 16 is pivotally mounted on head 12, and when the cap is in the closed position of FIGS. 1–3, it is latched in that position, as will be described. A push-button 18 is mounted on the side of head 12, and when the push-button is actuated it releases the cap 16 and causes it to flip up to its open position of FIG. 4. A peripheral rim on the top of head 12 forms a drinking area 20, the drinking area being covered by cap 16, as shown in FIGS. 8 and 9, when the cap is closed (FIG. 8) to keep the drinking area in a sanitary condition. As shown in FIG. 9, the upper rim around the drinking area is canted to facilitate drinking.

A drinking hole 22 is formed in the bottom of the drinking area. The hole 22 is closed by a plunger 24 when the cap is closed, as shown in FIG. 8. The drinking hole is opened when the cap is flipped up to its open position (FIG. 9) by actuation of push-button 18, and the plunger 24 is held away from the drinking hole to open the drinking hole when the push-button is held in a fully-depressed position. As mentioned above, the contents of the canteen may now be drunk through the drinking hole and by way of the drinking area 20. At any time, the drinking hole 22 may be closed by plunger 24 by releasing push-button 18, and cap 16 may be returned to its closed and latched position of FIG. 8.

Figure 5:
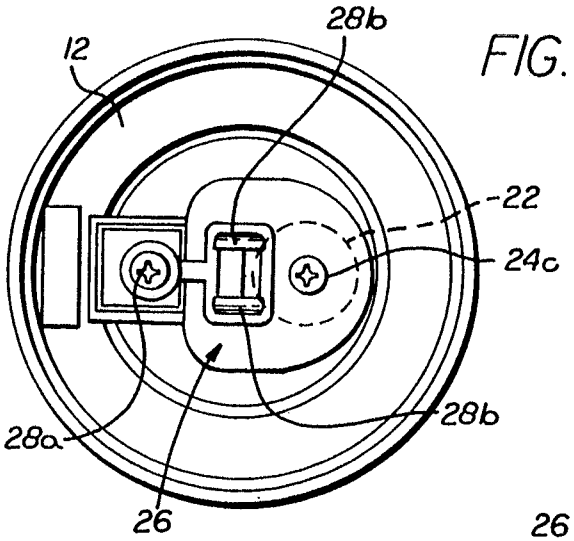
FIG. 5 is a bottom view of the head of the canteen showing the plunger subassembly in place, and releasably supported by a mounting member which, in turn, is secured to the underside of the head.
Figure 6:
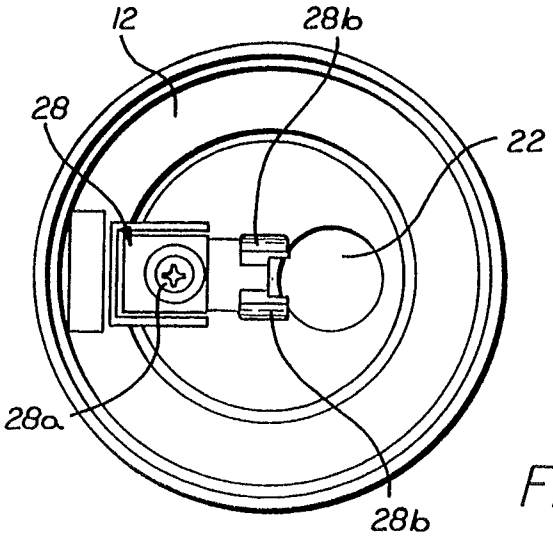
FIG. 6 is a view like FIG. 5, but with the plunger subassembly removed.

As shown in FIG. 5, the subassembly 26 which includes plunger 24 is releasably mounted on the underside of head 12 by a holder 28. This permits the subassembly 26 (FIG. 7) and the underside of head 12 (FIG. 6) to be easily removed from the head for cleaning purposes. Holder 28 is mounted on the underside of head 12 by a screw **28*a*. Holder 28 includes a U-shaped latch 28*b* which releasably holds the plunger subassembly 26 in place. The plunger subassembly may be removed merely by squeezing the two arms of latch 28*b*** together.

Figure 7:
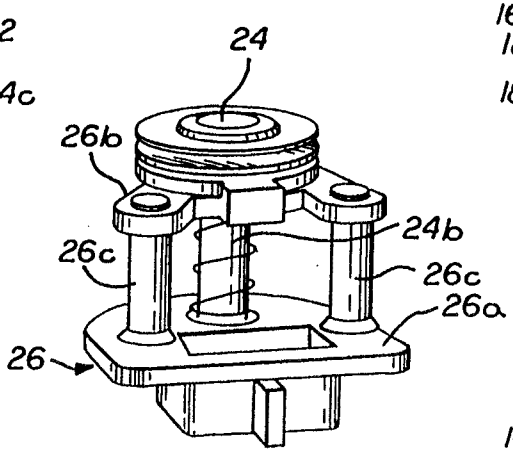
FIG. 7 is a perspective view of the removable plunger subassembly.

As best shown in FIG. 7, subassembly 26 includes a plastic bottom plate **26*a* and a plastic top plate 26*b*. The plastic top plate is slidable on plastic posts 26*c* which are molded to the bottom plate. Plunger 24 is mounted on the top plate 26*b* and is slidable with the top plate against the bias of a spring 24*b*. A screw 24*c* is threaded to the lower end of a post. 24*d* which extends coaxially through the spring to the plunger 24**, the screw acting as a stop.

Push-button 18 engages a push-rod 30 which is biased by a spring 32, and which is attached to a cam 34. When the push-button 18 is actuated, cam 34 engages the top plate **26*b* of the subassembly 26 and causes the top plate 26*b* to slide on posts 26*c* against the bias of spring 24*b* to move plunger 24 away from the drinking hole 22 (FIG. 9). This causes the drinking hole to be opened. Also, as shown in FIG. 8, a latch 16*a* on top 16 engages a latch 18*a*. When the push-button 18 is actuated from the position of FIG. 8 to the position of FIG. 9, it moves latch 18*a*, releasing latch 16*a*. At the same time, a projection 18*b* attached to the push-button 18 engages a projection 16*c* on top 16 to flip up the top of position of FIG. 9**.

The invention provides, therefore, an improved canteen which includes a flip-up cap that can be opened by actuating a push-button on the side of the head of the canteen. The flip-up cap, when closed, keeps the drinking area on the top of the head in a clean and sanitary condition. The push-button also serves to open a drinking hole in the bottom of the drinking area when it is actuated to its full extent and held in that position.

When the push-button is released, a plunger mechanism closes the drinking hole tightly and holds it from leaking. The plunger mechanism is a separate piece to make it easy to wash thoroughly. After washing, the plunger mechanism may be snapped back into place on a holder mounted on the underside of the head. The drinking area is surrounded by a rim which is specially shaped to facilitate drinking from the canteen.

It will be appreciated that while a particular embodiment of the invention has been shown and described, modifications may be made. It is intended in the claims to cover all such modifications which fall within the true spirit and scope of the invention.

I claim:

1. A canteen including a cylindrical container having a closed bottom and an open top; a head removably mounted on the open top of the container and having a peripheral rim defining a drinking area on the top of the head with a drinking hole extending through the head at the bottom of the drinking area; a cap pivotally mounted on the head and angularly movable from a closed position in which it covers said rim and encloses the drinking area to an open position; a plunger subassembly including a spring-loaded plunger for closing the drinking hold; means for mounting the plunger subassembly on the underside of the head with the plunger closing the drinking hole; a push-button slidably mounted on the side of the head; a spring-loaded mechanism coupling the push-button to the plunger subassembly to cause the push-button to move the plunger away from the drinking hole when the push-button is actuated and to cause the plunger to close the drinking hole when the push-button is released; a latch for holding the cap in its closed position; and a further mechanism coupling the push-button to the latch to release the latch and flip up the cap to its open position when the push-button is actuated.

2. The canteen defined in claim 1, in which said plunger subassembly is removably mounted on said mounting means.

3. The canteen defined in claim 1, in which said peripheral rim around the top of said head and which defines said drinking area is canted to facilitate drinking from the drinking area when the canteen is tilted.

* * * * *